US005119647A

United States Patent [19]

Godau

[11] Patent Number: 5,119,647

[45] Date of Patent: Jun. 9, 1992

[54] DYEING PADDER FOR THE DYEING OF WARP YARN

[76] Inventor: Eckhardt Godau, Via Collina 9, CH-6962 Lugano-Viganello, Switzerland

[21] Appl. No.: 486,619

[22] Filed: Feb. 28, 1990

[30] Foreign Application Priority Data

Mar. 1, 1989 [DE] Fed. Rep. of Germany ..... 3906391

[51] Int. Cl.[5] ..... D06B 3/18

[52] U.S. Cl. ..... 68/22 R; 68/158; 68/175

[58] Field of Search ..... 68/22 R, 158, 175; 8/147, 148, 151, 158; 118/423

[56] References Cited

U.S. PATENT DOCUMENTS

| | | | |
|---|---|---|---|
| 306,695 | 10/1884 | Lorrimer | 68/22 R |
| 3,484,915 | 12/1968 | Griffin . | |
| 3,602,125 | 8/1971 | Hersh | 68/175 |
| 4,095,443 | 6/1978 | Hasselschwert | 68/207 |
| 4,246,668 | 1/1981 | Spillman et al. | 68/22 R |
| 4,246,669 | 1/1981 | Davis | 68/158 |
| 4,416,124 | 11/1983 | Godau | 68/175 |
| 4,546,624 | 10/1985 | von der Eltz et al. | 68/22 R |
| 4,702,092 | 10/1987 | Turner | 68/175 |

FOREIGN PATENT DOCUMENTS

| | | | |
|---|---|---|---|
| 0385412 | 2/1990 | European Pat. Off. . | |
| 1278979 | 10/1968 | Fed. Rep. of Germany | 68/22 R |
| 2103423 | 8/1972 | Fed. Rep. of Germany | 68/22 R |
| 3612999 | 10/1982 | Fed. Rep. of Germany | 68/22 R |
| 2269379 | 7/1974 | France . | |

*Primary Examiner*—William A. Cuchlinski, Jr.
*Assistant Examiner*—G. Bradley Bennett
*Attorney, Agent, or Firm*—Herbert Dubno

[57] ABSTRACT

A dyeing padder for the dyeing of warp yarn includes a dyeing vat having at least two sectional and mutually connected vat chambers both used in a dyeing process with indigo dyes or alternatively, only one of the sectional vats is used, a displacement body introduced in the dyeing vats for reducing a volume of a dye bath having a continuous circulation thereof at a constant level.

26 Claims, 6 Drawing Sheets

DYEING PADDER FOR THE DYEING OF WARP YARN

FIELD OF THE INVENTION

The invention relates to a dyeing padder comprising a dyeing vat and one or more squeezing mechanisms for the dyeing of warp yarn, especially cotton warp yarn, whereby in the dyeing vat rollers and/or deflection rollers are provided for the guidance of the warp yarn strand through the dyeing vat.

BACKGROUND OF THE INVENTION

The known dyeing padder—a dyeing vat for a dye bath with a squeezing mechanism—consists of a simple roller vat, wherein the warp to be dyed is impregnated by being guided, deflected and finally squeezed via several cylinders or rollers and/or deflection rollers located under the level of the dye bath. The path travelled by the warp in the dye bath is determined by the number of the mentioned immersed rollers and deflection rollers and the distance between them. Since the dyeing speed is predetermined in the case of indigo dye and is practically never changed, the immersion time is constant and depends solely on the construction of the dyeing vat. But now the market demands a variety of shades of indigo denim and also other colors. However, in other colors, such as "black denim" or "color denim", only a very poor quality can be obtained with the conventional indigo dyeing vats. Other colors are dyed with other dye groups, mostly sulfur dyes or vat dyes. These, and also other cotton dye groups, such as reactive and direct dyes, have a considerably higher affinity to cotton than indigo. When using the conventional dyeing vats (dyeing troughs, dyeing becks or dyeing chassis) with other affinity dyes a strong color drain also called "shading" results. Due to the affinity, the dye is "extracted" from the dye bath, and the batch is more strongly colored at the beginning than at the end, a phenomenon which is also called "head-tail" drain. This is a very undesirable dyeing effect, since it can appear over several thousand meters of the materials to be dyed, which then becomes seconds.

In the piece-dyeing process (dyeing of fabrics) it is known and usual to consider dyeing vats with a very small content of dye bath, the socalled "saving vats". These baths can contain only 40 l or less of dye bath. It is also known in the piece-dyeing process to displace the dye bath in normal dyeing vats with so-called displacement bodies. However, these special dyeing vats also have the disadvantage of very short immersion paths. Also, another common feature is that their immersion path is predetermined and cannot for instance be cut in half or doubled, unless the goods to be dyed are taken out and then reintroduced in the dyeing vat in such a way that rollers are skipped or previously skipped rollers are used. This is fairly simple in the case of woven goods, but becomes very complicated affecting quality of warps consisting of several thousand individual threads.

OBJECTS OF THE INVENTION

It is thereby the object of the invention to provide an improved dyeing padder suitable for the dyeing of warp yarn, especially cotton warp yarn, using alternately indigo affinity dyes, particularly, sulfur dyes and vat dyes.

Another object is to allow the content of the dye bath and the immersion time to be variable in a simple manner, i.e. without the aforedescribed extraction and immersion of the warp, so that they are optimally usable with the respective dyes. It is also an object, in the case of indigo dyeing, to enable the dyeing padder to contain 800 to 1,000 liters of dye bath, and for the dyeing with other dye groups, a dye bath of 150 to 300 liters, since these amounts of dye bath have proven to be optimal in practice, the transition from indigo dyeing to dyeing with other dye groups and vice versa being carried out quickly and simply.

SUMMARY OF THE INVENTION

According to the invention, this is achieved by providing a dyeing vat with a plurality of rollers defining a path of warp in the vat including two adjacent interconnected chambers.

According to the invention, the sectional vats can have the same volume. In one of the sectional vats a displacement body can be inserted to reduce the volume of the sectional vat receiving the dye.

Preferably, the volume of the dyeing vat receiving the dye bath is larger than the volume of the sectional vats.

In an upper area of the dyeing vat there can be a connection between the sectional vats and the surface of the dye bath is determined by the larger volume of dye bath contained in the dyeing vat during the dyeing with indigo dyes and the smaller volume of dye bath contained in the sectional vat during dyeing with affinity dyes. Above this connection but below the surface of the larger indigo dye bath the two deflection rollers (2*a*, 2*b*) are disposed. At least two deflection rollers are arranged above the surface of the smaller dye bath for dyeing with affinity dyes. A further circulation pipe, which runs over the bottom and ends in a sectional vat is provided to evacuate the dye from the sectional vat through openings in the bottom of the sectional vat.

During dyeing with indigo dyes, these are fed by means of a distribution pipe over an intermediate pipe into a circulation vat and from there return to the circulation vat by passing through a crosspipe, the feeding pipe, the dyeing vat and a further circulation pipe.

During dyeing with affinity dyes the dyes are fed via a distribution pipe into the crosspipe and from its outlet into the feeding pipe and then through the feeding pipe, the one sectional vat, the further feeding pipe and an intermediate pipe to be recirculated into the feeding pipe.

The dyeing padder of the invention makes it possible to dye with the same device warps, especially of cotton threads, with either indigo dyes or affinity dyes, as desired. This is of considerable advantage, since such a dyeing padder meets the demand of the market, because it can furnish indigo-dyed goods when necessary as well as goods dyed, for instance, with sulfur dyes. The market for cotton goods dyed with sulfur black, e.g. black denim, already makes up appropriately 10% of the "blue-denim" market. But, since the "black denim" fraction is still smaller than the one for "blue denim", for the dyeing of "black denim" it is not necessary to provide a separate dyeing padder.

By subdividing the dyeing vat into two sectional vats as chambers of the dyeing vat, the device can be used for both dyeing processes, i.e. with a dye selected from the group consisting of indigo and affinity dyes. Since there is only one dyeing vat with the two sectional vats, it is possible to work with either a shorter time or a smaller dye bath. Compared to dyeing with the conventional dyeing padder, with preestablished traveling speed of the warp through the dye bath, the dyeing time is cut by approximately one half, and the required amount of dye bath is also reduced to approximately half of the heretofore used amounts.

Due to the dyeing padder of the invention, the "head-tail" drain effect occurring during dyeing with affinity dyes in the conventional dyeing vats used for this purpose is totally avoided.

By means of the displacement body, the volume of the one sectional vat required for the dyeing with affinity dyes is reduced in a simple manner to the volume required for this process, whereby the dyeing padder is designed so that the displacement body can remain inserted in this sectional vat, also when the dyeing process with indigo dyes, with a larger content of dye bath, takes place.

The transition of the dyeing vat from the setting for indigo-dyeing of warp to the setting for dyeing with affinity dyes is performed in a simple manner, basically due to resetting (opening and/or closing) of a few valves in a very short time.

The dyeing padder of the invention saves a separate dyeing padder for the dyeing process with affinity dyes, reduces the dyeing time and the required amount of dye bath, avoids a feared dyeing defect and furthermore improves the quality of dyeing. As a result, important savings are achieved in comparison to known dyeing padders, so that with the dyeing padder of the invention it is possible to achieve a particularly economical dyeing process.

BRIEF DESCRIPTION OF THE DRAWING

The above and other objects, features and advantages of my invention will become more readily apparent from the following description, reference being made to the accompanying highly diagrammatic drawing in which:

FIGS. 2 and 4 are views of a dyeing padder corresponding to FIGS. 1 and 2 with dye bath during dyeing with indigo dyes.

SPECIFIC DESCRIPTION

Figure 1:
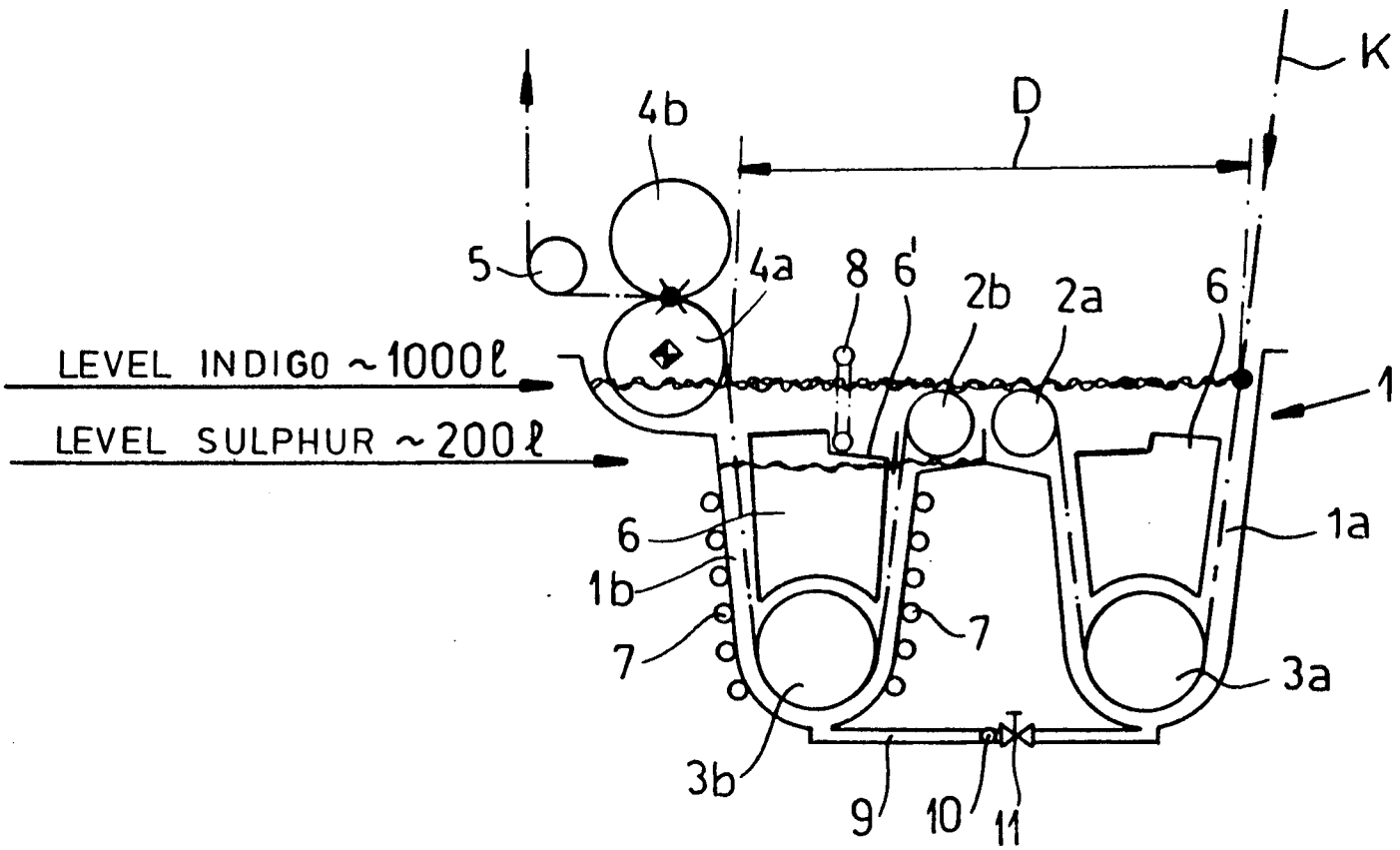
FIG. 1 is a lateral sectional view of a dyeing padder according to the invention.

FIG. 1 shows a dyeing padder trough 1 (dyeing vat) which can be filled with dye bath, in a lateral view in longitudinal section. The dyeing vat 1 is subdivided into two individual sectional vats 1*a* and 1*b* respectively forming first and second chambers connected in the upper area of the vat 1. The inner walls of the sectional vats 1*a* and 1*b* facing each other run approximately horizontally and are connected below the upper edge of the vat 1 and the surface of the largest dye-bath. The distance of this connection from the surface of the dye bath is determined on the one hand by the larger desired dye bat volume of the vat 1 during dyeing with indigo, and, on the other hand, by the smaller dye bath content of the sectional vat 1*b* during the dyeing with sulfur dyes or vat dyes. It is also important to take into consideration the fact that above this connection, but below the surface level of the larger indigo dye bath two deflection rollers 2*a* and 2*b* guiding the warp K from vat 1*a* and 1*b* are arranged. Such a structure therefore has the dyeing vat 1 including two chambers or vats 1*a* and 1*b* mutually connected in the upper area of the dyeing vat 1.

The total volume of dyeing vat 1 is so designed that it can contain the amount of dye bath of about 1,000 liters required for indigo dyeing according to the embodiment shown in FIG. 1. Inside each of the sectional vats 1*a* and 1*b*, in the vicinity of a bottom area and at a distance from the vat bottom, a respective roller (cylindrical body) 3*a*, 3*b* is arranged. In the area shown to the left in FIG. 1, basically above the surface of the larger dye bath a squeezing mechanism SM is shown.

The mechanism includes deflection rollers 4*a* and 4*b*, arranged one above the other and a deflection roller 5 spaced from the deflection rollers.

The warp K is first guided into the sectional vat 1*a* by the roller 3 and is further directed over the deflection roller 2*a* upon passing the roller 2*a* the warp K is guided over the deflection roller 2*b* into the sectional vat 1*b*, wherein it travels under the roller 3*b* and is then guided upwardly over it, out of the sectional vat 1*b* and to the squeezing mechanism 4*a*, 4*b* where the excess dye is removed from warp K. A portion of the warp path between the squeezing mechanism and roller 5 is generally horizontal. The warp is removed from the roller 5 upwardly at a right angle.

The deflection rollers 2*a* and 2*b* have a diameter half the size of the diameters of each of the rollers 3*a*, 3*b*, 4*a* and 4*b*. The deflection roller 5 also has such a diameter equal to the rollers 2*a* and 2*b*.

As already mentioned, the dyeing vat 1 has a total volume for receiving a dye bath of approximately 1,000 liters. In the embodiment shown in FIG. 1, each of the sectional vats 1*a* and 1*b* has approximately a volume of approximately 600 liters of dye bath. Therefore for the dyeing with sulfur dyes or vat dyes, requiring a dye bath of only 150 to 300 liters, the sectional vat 1*b* is filled with only approximately 200 liters of dye bath, and therefore the desired dye bath of approximately 200 liters is achieved due to the fact that from above dyeing vat 1, a hollow closed displacement body 6 with a volume of approximately 400 liters is introduced into the sectional vat 1*b*. This body is able to slide up and down into the sectional vat 1*b*, along guide tracks not shown in the drawing. Preferably, the displacement body 6 is introduced approximately centrally into the sectional vat 1*b* and is spaced apart from the roller 3*b*. The bottom of the body is concavely curved, so that the warp K traveling through the sectional vat 1*b* can pass without being in contact. As can be seen from FIG. 2, the displacement body 6 can be guided laterally until it comes close to the lateral walls 1' and 1'' of the dyeing vat 1. Its size and shape is adjusted to the inside of the sectional vat 1*b*, without impairing or disturbing the travel of the warp K through this sectional vat and is determined by the fact that 400 liters of dye bath have to be displaced by this body. During dyeing with indigo, as well as during dyeing with sulfur dyes of vat dyes, it is located in the sectional vat 1*b*, but can be removed easily from the sectional vat 1*b* over the guide tracks not shown in the drawing by simply being lifted out of the sectional vat 1*b* and the dyeing vat 1, for instance in order to clean the dyeing vat 1.

As shown in FIG. 1 heating coils 7 are affixed to the outer walls of the sectional vat 1*b* for the dyeing with affinity dye groups as well as sulfur dyes. A feeding pipe 8 for the supply of dyes is introduced into the padder and extends above the dyeing vat. According to FIG. 1, the pipe is arranged above the sectional vat 1*b* with an outlet opening located above the (inserted) displacement body 6 so that the surface of the displacement body 6 in this area has an inclined portion 6' in order to prevent the possible deposition of a dye.

In the bottom area of the dyeing vat 1, underneath the sectional vats 1*a* and 1*b*, a circulation pipe 9 connecting both sectional vats is mounted on bottoms. During dyeing with indigo, through this pipe dye bath from one sectional vat 1*a* and 1*b* can be displaced to the other. This pipe has a centrally located closable opening 10 and a valve 11, through which dye bath can be evacuated from the sectional vats 1*a* and 1*b*.

From the preceding description it has already become clear that during dyeing with indigo with a dye bath content of approximately 1,000 liters, both sectional vats 1*a* and 1*b* with common portion of the dyeing vat are filled with dye bath to a point located above the deflection rollers 2*a*, 2*b* (LEVEL INDIGO ~ 1000 l in FIG. 1). The distance D between the immersion point of the warp in the dye bath in the dyeing vat 1 and the withdrawal point equals 4.6 m in the embodiment example shown in FIG. 1. During dyeing with sulfur dyes, only the chamber of dyeing vat 1 forming the sectional vat 1*b* is filled with sulfur dye (see LEVEL SULFUR ~ 200 l in FIG. 1). In this case, the surface of the dye bath in longitudinal section measures 2.0 m.

Figure 2:
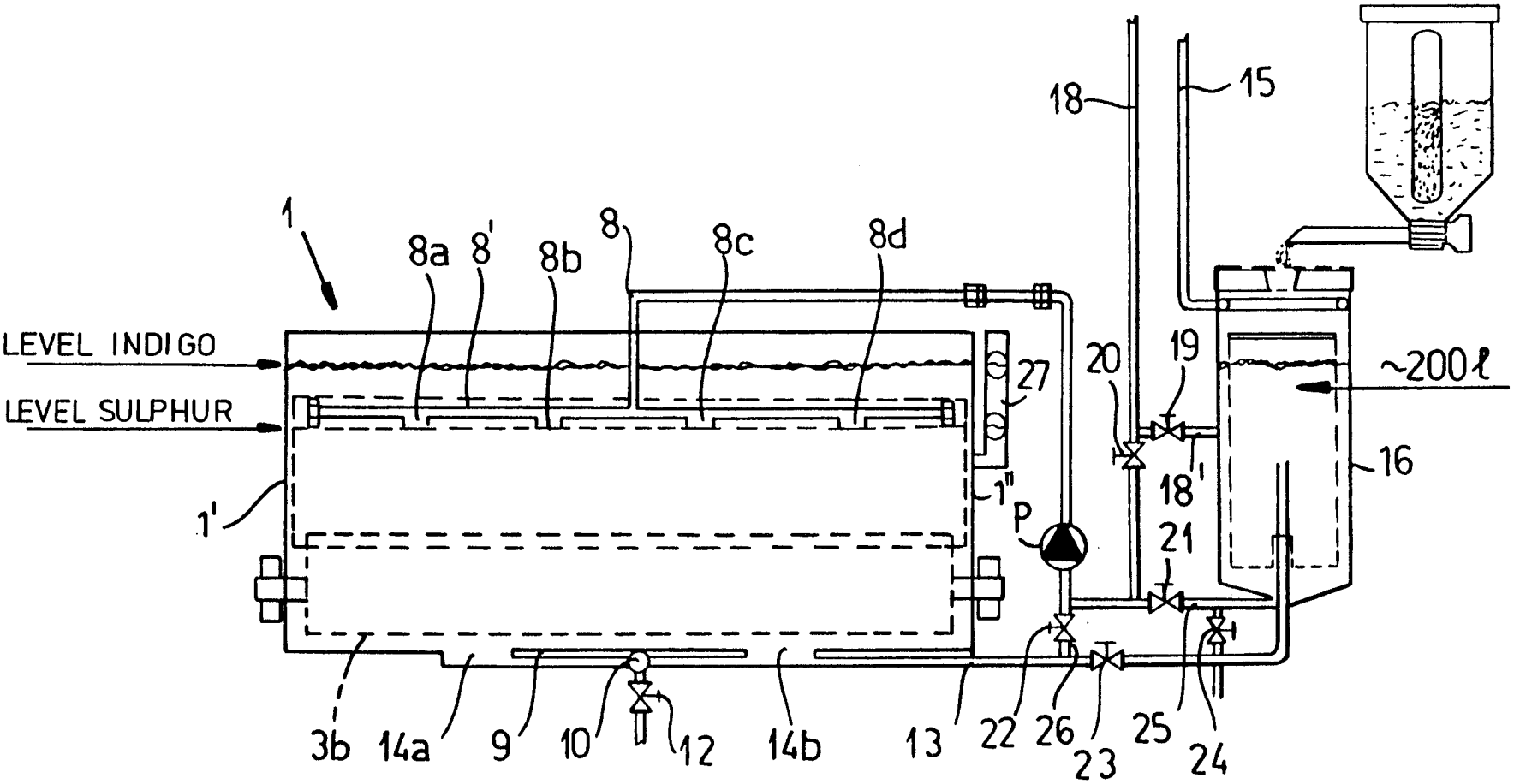
FIG. 2 is a frontal sectional view of a dyeing padder of FIG. 1.

FIG. 2 shows the dyeing vat 1 with lateral walls 1' and 1''. The width of the dyeing vat 1 is determined by the width of the warps to be dyed. In FIG. 2, the identical parts are marked with the same reference numerals as in FIG. 1. The warps K and the deflection rollers and rollers 2*a*, 2*b*, 4*a*, 4*b* and 5, as well as the heating coils 7 are omitted in FIG. 2, for the sake of simplicity. The roller 3*b* lies behind the roller 3*a*, in the sectional vat 1*b*. The displacement body 6 is mounted above the roller. Above the dyeing vat 1 the feeding pipe 8 with a portion turned downwardly at 90 is shown. The pipe has a crosspipe 8' which during the dyeing with indigo lies beneath the surface of the dye bath and is fastened on the inside to the side walls 1' and 1'' of the dyeing vat 1. The cross pipe 8' lies above the dye bath surface during the dyeing process with sulfur dyes of vat dyestuffs and in the embodiment shown in FIG. 2 has four lower outlet openings 8*a*, 8*b*, 8*c* and 8*d* for the dye, which are distributed over the width of the dyeing vat 1. The roller 3*b* shown in FIG. 2, as well as all other rollers running in the dye bath is preferably supported outside the dyeing, so that the dyeing vat 1 with its sectional vats 1*a* and 1*b* forming its chambers can be operated without damaging the rollers "lubricated" by the dye bath.

On the bottom of the dyeing vat 1, circulation pipe 9 can be seen, which has a discharge outlet 10 a valve 12. Through the shown tubularly shaped discharge outlet 10 the dye bath can be drained from the dyeing vat 1. A further circulation pipe 13 enters the sectional vat 1*b* over the bottom of the dyeing vat 1, and through this pipe the dye bath can be drained from the sectional vat 1*b* through openings 14*a* and 14*b* in the bottom of the sectional vat 1*b*.

According to FIG. 2, a fresh-water supply pipe 15 ends in a circulation vat 16 for the indigo dye holding approximately 200 liters of dye bath. Above it, a container 17 for pulverized hydrosulfite with the known composition is provided, which when required during indigo dyeing is emptied in the circulation vat. A distribution pipe 18 for the dye comes from a dye tank not shown in the drawing, and in the case of indigo dyeing, feeds the dye through an intermediate pipe 18' into the circulation vat 16. By means of pump p in the feeding pipe 8, the dye is fed to the dyeing vat 1 and the dye bath is kept circulating. Valves are marked with the numerals 19, 20, 21, 22, 23 and 24. During indigo dyeing, for instance, the valve 19 in the intermediate pipe 18' is open, so that dye flows from the distribution pipe 18 and through the intermediate pipe 18' into the circulation vat 16, then into a cross-pipe 25 with open valve 21 and from there into the feeding pipe 8. The valves 12, 20, 22 and 24 are closed in this case. From the dyeing vat 1 and through the openings 14*a* and 14*b* in the bottom area of the dyeing vat 1, the dye bath enters the further circulation pipe 13 and through this and the open valve 23, reaches again the circulation vat 16. Hence a first means for supplying or filling with indigo dye includes the circulating vat 16.

During dyeing with affinity dyes, such as sulfur dyes or vat dyes, the circulation vat 16 and the tank 17 do not operate. Hence the second means for supplying or filing with another dye includes the piping 18 etc. without the circulating vat. In this case, the valves 12, 19, 21 and 23 and 24 are closed, while the valves 20 and 22 are open. The dye flows in this case from the dye tank 18'' through the distribution pipe 18 in the portion of the cross-pipe 25 which is not closed, from here through the feeding pipe 8 in this into the sectional vat 1*b* of the dyeing vat 1, whereby again the dye bath is drained through the openings 14*a* and 14*b* in the further circulation pipe 13 and then reaches again the feeding pipe 8 through the further intermediate pipe 26 with open valve 22. Here too, by means of pump p, the dye is fed to the dyeing vat 1, respectively to its sectional vat 1*b* and the dye bath is kept circulating.

The manner in which the circulation of the dye bath is carried out, i.e. the pump-assisted drainage of the dye bath at the bottom of the sectional vats 1*a* and 1*b* and the feeding of the dye bath over the entire width of the sectional vat 1*b* insures a perfectly thorough mixing of the dye bath and thereby a perfect admixture of fresh dye bath coming from the distribution pipe 18.

The dosage of the dye bath takes place through so-called addition impregnation proportional to the weight of the goods to be dyed.

A level regulator 27 controls the level of the dye bath in the case of indigo dyeing and in the case of dyeing with affinated dye groups, so that the corresponding dye bath content is kept at a constant level in the dyeing vat 1, respectively the sectional vat 1*b*. The dye bath level is kept constant by the level regulator 27 through the addition of fresh water from the feeding pipe 15 or of dye bath from the distribution pipe 18. This way, the feeding and the drainage of the dye bath takes always place "under dye-bath conditions" i.e. at the same level of dye bath desired in each case, so that the warp to be dyed is not at all exposed or only minimally exposed to air during the dyeing process, thereby precluding a premature oxidation.

Figure 3:
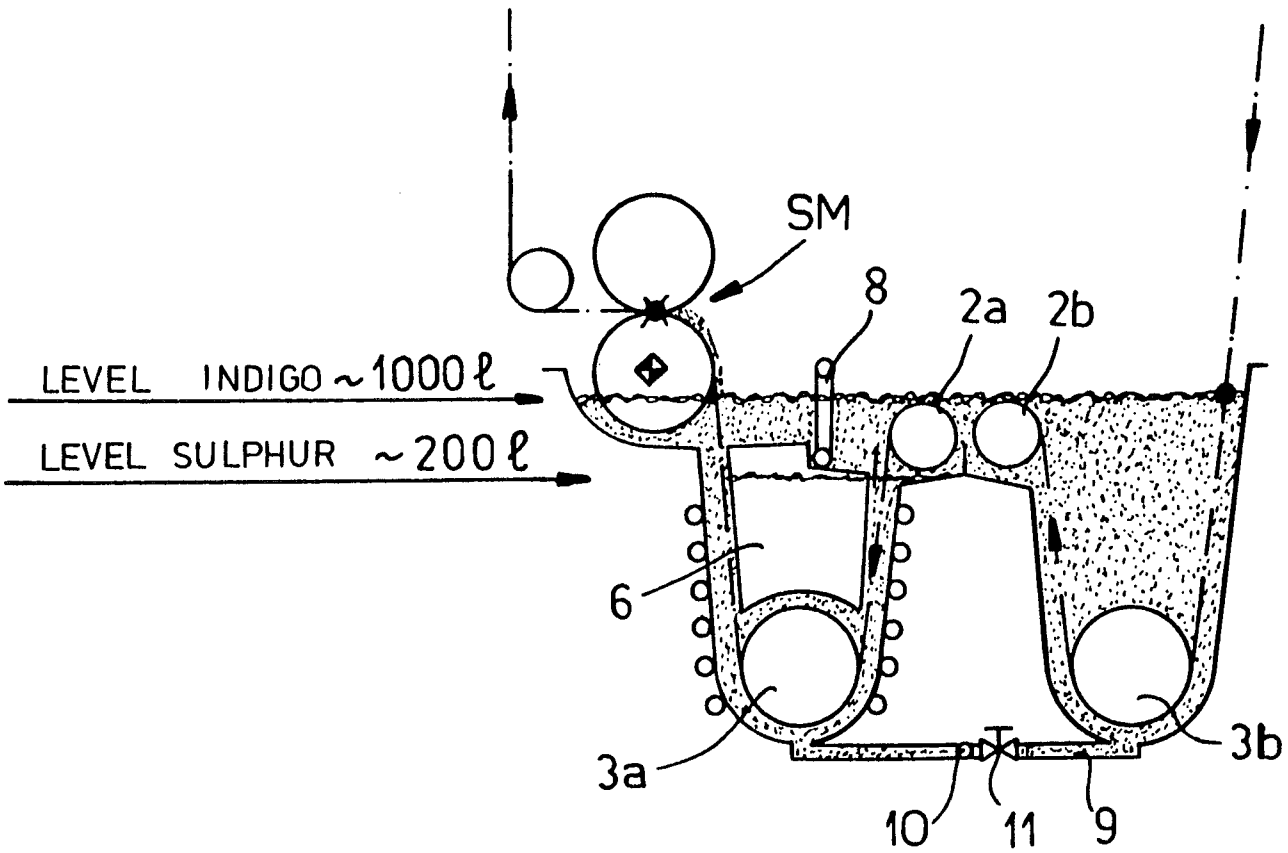
Figure 4:
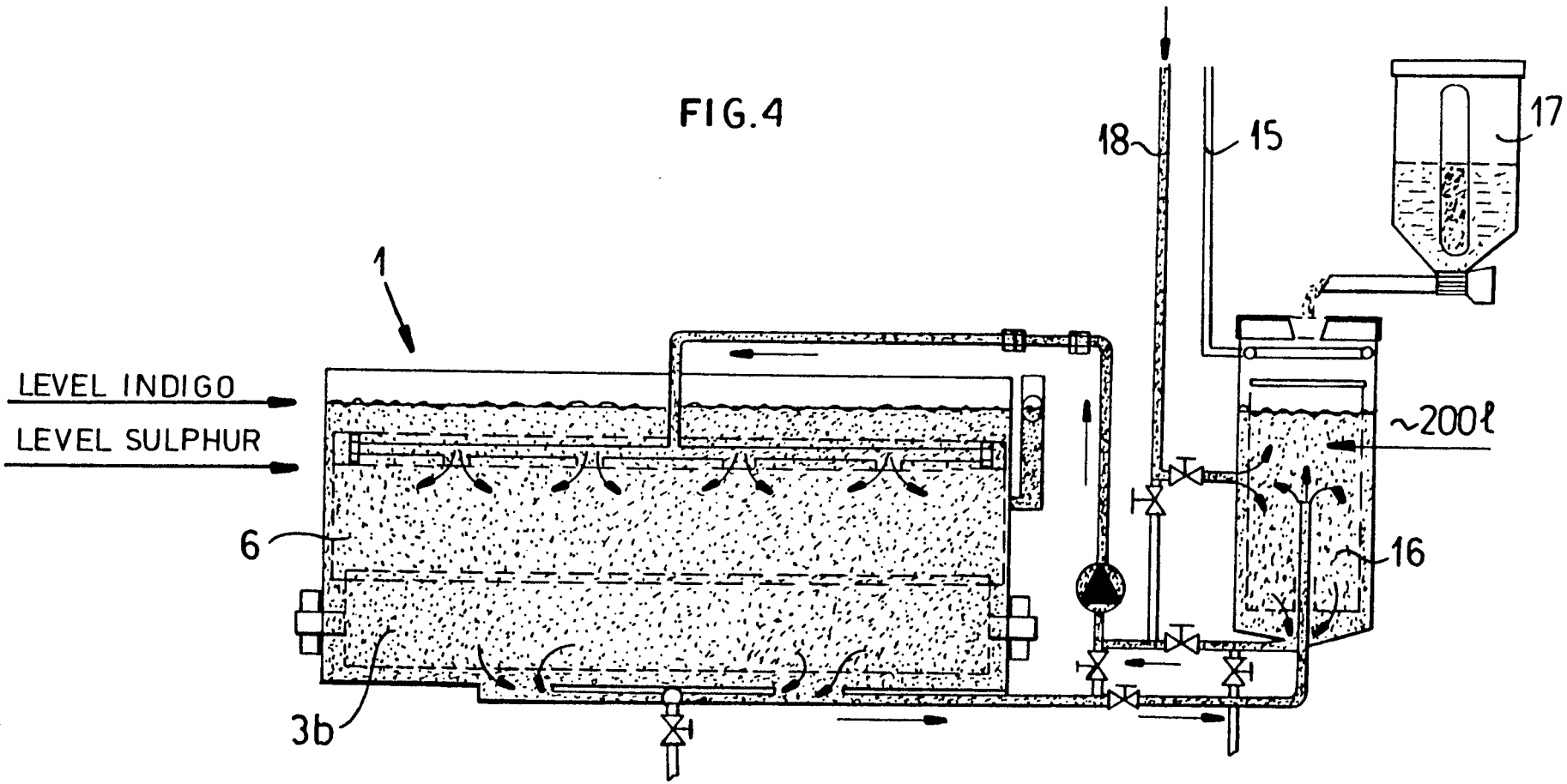

In FIGS. 3 and 4, the indigo dyeing process is shown The dark portions show the dye bath and its circulation, which is illustrated by arrows. It can be seen that during indigo dyeing one operates with a large dye and the circulation takes place with the circulation vat 16.

Figure 5:
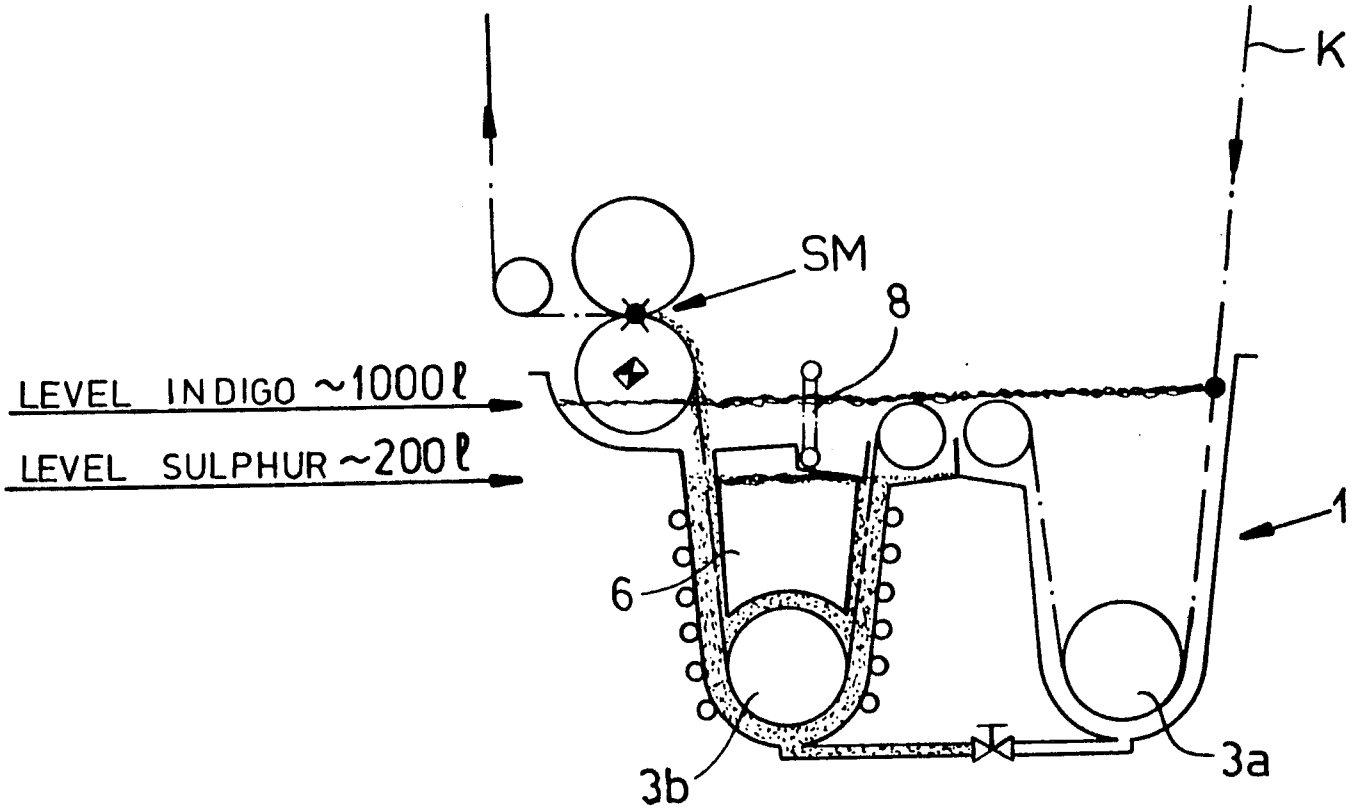
FIGS. 5 and 6 are views of a dyeing padder corresponding to FIGS. 1 and 2 with dye bath, during dyeing with affinity dyes.
Figure 6:
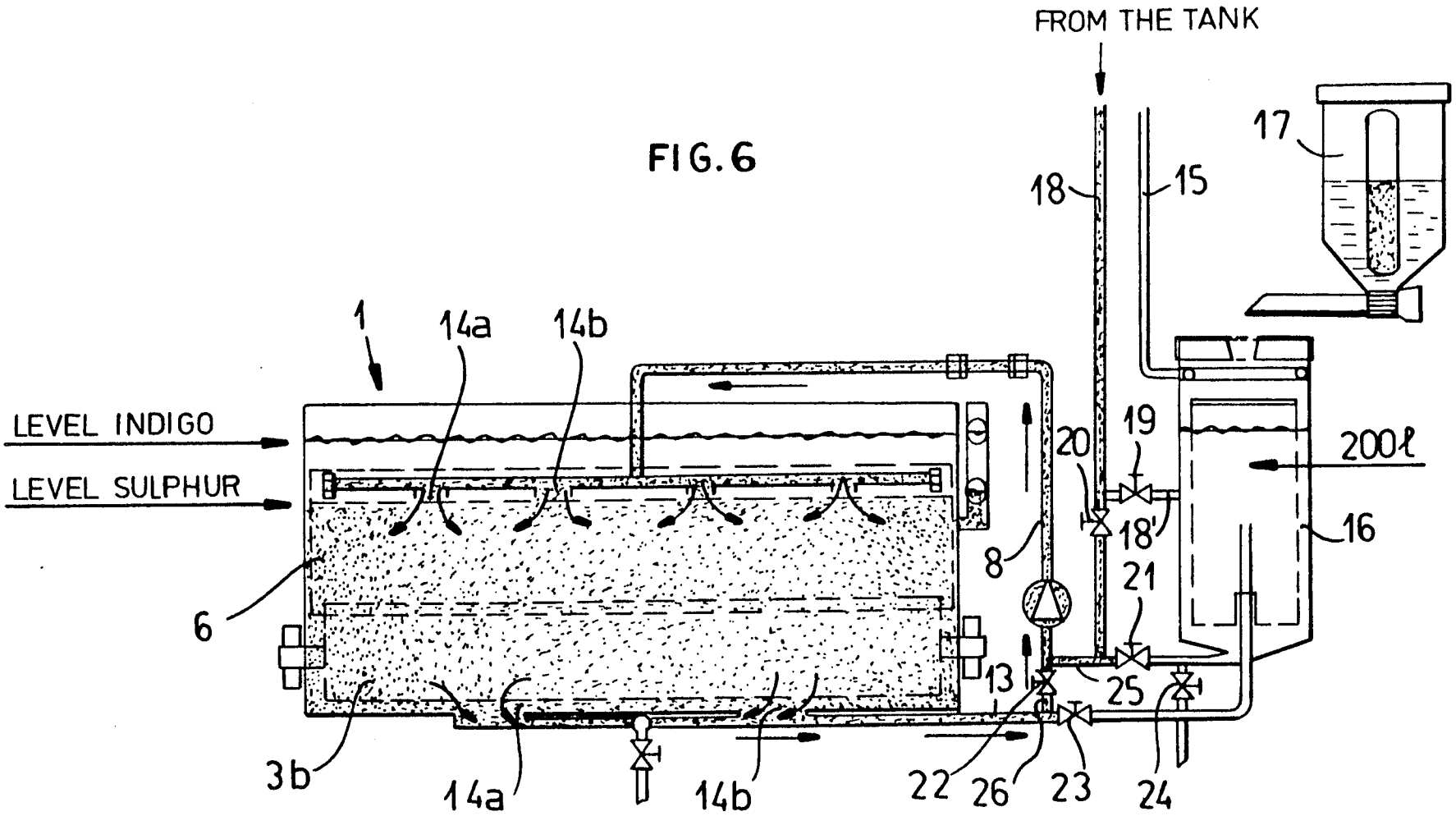

FIGS. 5 and 6 illustrate the dyeing process with affinity dyes, in this case, sulfur dyes, is shown. The dark portions show again the dye bath and its circulation, which again is illustrated by arrows. It can be seen that during dyeing with affinity dyes, one works with a small dye bath and with "short circulation" (without circulation within the circulation vat 16).

If the dyeing vat 1 according to FIGS. 1 and 2 is designed for a content of approx. 1,000 liters during indigo dyeing and the sectional vat 1*b* is designed for a dye bath content of approx. 200 liters during dyeing with affinity dyes, variations which are not shown in the drawing concerning the amount of dye bath are possible.

For instance, the sectional vats 1*a* and 1*b* (without the displacement body 6) can have a volume capable of containing 800 liters of dye bath each, or 1,600 liters together. It is also possible to immerse a displacement body 6 in each of the sectional vats 1*a*, 1*b*, whereby then each sectional vat has a volume of approximately 600 or 400 liters, and both sectional vats 1*a*, 1*b* together have a volume of approximately either 1,200 or 800 liters for containing the dye bath.

The aforementioned three variants with a common volume of approximately 1,660, 1,200 and 800 liters are particularly suited for indigo dyeing, whereby the variant with a common volume of approximately 1,200 liters can mainly be found in use in indigo dyeing. The first variant with a common volume of approximately 1,600 liters is to be considered especially for dyeing with indigo dyes with a high throughput of goods at very high speed and with heavy warps.

The variant with a common volume of approximately 800 liters is particularly suited for dyeing with low-affinity dyes, which for the fixation, respectively for better penetration of the dye on, respectively into, the warp require a longer dipping path.

A further variant is conceivable, wherein only the sectional vat 1*a* without the displacement body 6 is filled with dye bath as a dyeing vat, whereby the sectional vat 1*a* has a volume of approximately 600 liters. This variant is also suited for dyeing with indigo dyes.

Besides, there is also another variant, wherein only the sectional vat 1*b* with the displacement body 6 is filled with dye bath as dyeing vat, whereby the sectional vat 1*b* has a volume of approximately 200 liters. This variant is mot advantageous for all dye groups, except indigo dyes, since the high affinity of these dyes require a small content of dye bath, in order to prevent a "head-tail" color drain.

I claim:

1. A dyeing padder for dyeing of warp yarn, particularly cotton warp yarn, comprising:

a dyeing vat having a bottom for dyeing a warp yarn, said dyeing vat being formed with two sectional vats forming first and second chambers connected with one another;

a plurality of guiding rollers in said dyeing vat defining a path of the warp yarn through said vat having an immersing point of said warp yarn entering said first chamber and an emersing point at which said yarn is pulled out of said second chamber;

at least one squeezing mechanism along said path receiving said warp yarn upon emmersing thereof;

a circulation vat operatively connected with at least one of said chambers;

a distribution pipe delivering a dye selected from the group consisting of an indigo dye and an affinity dye into said dyeing vat, said distribution pipe being formed with an intermediate pipe extending therefrom into said circulation vat;

a cross-pipe spaced from said intermediate pipe and connected with said circulation vat and with said distribution pipe below said intermediate pipe;

a feeding pipe connected with said cross-pipe for distributing said dye into said dyeing vat;

a circulation pipe extending between said bottom and said circulation vat and operatively connected with said feeding pipe; and means for filling said dyeing vat with said dye, said indigo dye being fed through said distribution pipe and through said intermediary pipe being pumped along a first endless path of said indigo dye traversing said circulation vat downstream of intermediate pipe, said cross-pipe downstream of said circulation vat, said distribution pipe and said circulation pipe located downstream of said feeding pipe and delivering said indigo dye back to said circulation vat, said affinity dye being fed by said distribution pipe being pumped along a second endless path of said dye groups traversing said cross-pipe, said feeding pipe downstream of said cross-pipe, said second chamber of the dyeing vat and said circulation pipe delivering said affinity dye back to said feeding pipe.

2. The dyeing padder defined in claim 1 wherein both of said first and second chambers contain the same volume of the dyeing bath.

3. The dyeing padder defined in claim 1 wherein at least one of said first and second chambers receives a respective removable displacement body reducing a volume thereof, said body fitting an interior of said one of said chambers and being used during both the dyeing with said indigo dye and with said affinity dye.

4. The dyeing padder defined in claim 1 wherein said first and second chambers are connected with one another by a passage located at a distance from said bottom of the dyeing vat, at least two of said plurality of guiding rollers having an identical diameter being mounted in said passage, said passage being limited by respective inner walls of each of said first and second chambers running generally horizontally into one another and by an upper edge of the dyeing vat, each of said first and second chambers being provided with a respective other one of said guiding rollers, said respective other guiding rollers being mounted in the respective first and second chambers close to the bottom of said dyeing vat and having a diameter twice as large as said diameter of said rollers mounted in said passage, each of said rollers being provided with a respective shaft protruding from an interior of said dyeing vat.

5. The dyeing padder defined in claim 1 wherein a volume of said indigo dye contained in said dyeing vat is larger than a volume of said affinity dye in said dyeing vat.

6. The dyeing padder defined in claim 3 wherein the dyeing vat contains a volume of the dye bath of approximately 1,000 liters during the dyeing with the indigo dye.

7. The dyeing padder defined in claim 3 wherein said volume of the circulation vat contains a dye bath of approximately an additional 200 liters of dye bath.

8. The dyeing padder defined in claim 3 wherein said one of said first and second chambers with the displacement body inserted therein is designed for a dye bath of approximately 200 liters during dyeing with an affinity dye.

9. The dyeing padder defined in claim 3 wherein each of said first and second chambers receives a respective removable displacement body, said first and second chambers having a volume capable to contain approximately 800 liters of dye bath.

10. The dyeing padder defined in claim 3 wherein said dyeing vat without said body contains a volume of approximately 1,600 liters of dye bath.

11. The dyeing padder defined in claims 9 wherein said first and second chambers reach receiving a respective one of said displacement bodies have a volume capable to contain approximately 1,200 liters of dye bath.

12. The dyeing padder defined in claim 1 wherein a distance between the immersing point of the warp into the dye bath and the emmersing point thereof equals 4.6 m upon dyeing with the indigo dye.

13. The dyeing padder defined in claim 1 wherein a distance between the immersing point of the warp into the dyeing bath and the emmersing point thereof is about 2.0 m upon dyeing with the affinity dye.

14. The dyeing padder defined in claim 1 wherein said feeding pipe extends above said second chamber.

15. The dyeing padder defined in claim 1 wherein said pipe is formed with a plurality of outlet openings.

16. The dyeing padder defined in claim 1, further comprising a feed back pipe connected with said circulation pipe and being arranged between said first and second chambers.

17. The dyeing padder defined in claim 16 wherein said feedback pipe has a closable discharge opening for evacuation of the dye bath.

18. The dyeing padder defined in claim 1 wherein said circulation pipe is provided with openings for discharging the dye bath.

19. The dyeing padder defined in claim 1 wherein said dye is pumped by a pump mounted along the feed pipe.

20. The dyeing padder defined in claim 1 further comprises, regulating means mounted on said dyeing vat for controlling a level of said indigo dye and said affinity dye in said chambers; and a plurality of valves along said first and second paths operatively connected with said regulating means.

21. A dyeing padder for the dyeing of a warp yarn, comprising:

a dyeing vat formed with two mutually connected sectional vats;

first means including a circulating vat for supplying an indigo dye to said dyeing vat whereby said indigo dye fills both of said sectional vats and said dyeing vat to a relatively high level said circulating vat including means for circulating the indigo dye between said dyeing vat and said circulating vat;

second means for supplying another dye to one of said sectional vats for filling same to a level below said relatively high level;

means for selectively operating said first and second means so that said dyeing vat contains one of said dyes;

guide means including a plurality of spaced apart rollers defining a path of said warp yarn through said dyeing vat, said path lying fully below said high level, extending above said level below said high level between said sectional vats, and traversing both said sectional vats;

means for selectively limiting a liquid volume of said one of said sectional vats; and a pair of squeezing rollers at a downstream end of said path and above said high level for squeezing dye from said warp yarn, said means for limiting said liquid volume of said one of said sectional vats being a displacement body removably inserted in said one of said sectional vats.

22. The dyeing padder defined in claim 21 wherein said sectional vats have the same volume.

23. The dyeing padder defined in claim 21 wherein said guide means includes a respective large diameter roller proximal to a bottom of each of said sectional vats and a pair of smaller diameter rollers between said sectional vats at a connection between them.

24. The dyeing padder defined in claim 21 further comprising a guide track along which said displacement body is shiftable and along which said displacement body can be lifted out of said one of said sectional vats.

25. The dyeing padder defined in claim 21 wherein at said high level said indigo dye has a distance on an upper surface thereof between a point at which the warp yarn enters the indigo dye and said squeezing rollers of about 4.6 m, a distance along said surface between said point on a bath of said other dye and a point at which the warp yarn emerges therefrom being about 2.0 m.

26. A dyeing padder for the dyeing of a warp yarn, comprising:

a dyeing vat formed with two mutually connected sectional vats;

first means including a circulating vat for supplying an indigo dye to said dyeing vat whereby said indigo dye fills both of said sectional vats and said dyeing vat to a relatively high level said circulating vat including means for circulating the indigo dye between said dyeing vat and said circulating vat;

second means for supplying another dye to one of said sectional vats for filling same to a level below said relatively high level;

means for selectively operating said first and second means so that said dyeing vat contains one of said dyes;

guide means including a plurality of spaced apart rollers defining a path of said warp yarn through said dyeing vat, said path lying fully below said high level, extending above said level below said high level between said sectional vats, and traversing both said sectional vats;

means for selectively limiting a liquid volume of said one of said sectional vats; and a pair of squeezing rollers at a downstream end of said path and above said high level for squeezing dye from said warp yarn, each of said sectional vats has a volume of substantially 600 liters of a dye bath and said dyeing vat is connected with a circulation vat having a volume of approximately 200 liters of said dye bath.

* * * * *